US009162459B2

(12) United States Patent
Nagai et al.

(10) Patent No.: US 9,162,459 B2
(45) Date of Patent: Oct. 20, 2015

(54) LIQUID EJECTION HEAD

(71) Applicant: CANON KABUSHIKI KAISHA, Tokyo (JP)

(72) Inventors: Masataka Nagai, Yokohama (JP); Yoshinori Tagawa, Yokohama (JP); Jun Yamamuro, Yokohama (JP); Kenji Fujii, Yokohama (JP); Mitsuru Chida, Yokohama (JP); Makoto Watanabe, Yokohama (JP); Toshiaki Kurosu, Oita (JP); Takanobu Manabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/228,581

(22) Filed: Mar. 28, 2014

(65) Prior Publication Data

US 2014/0313261 A1 Oct. 23, 2014

(30) Foreign Application Priority Data

Apr. 17, 2013 (JP) ..... 2013-086468

(51) Int. Cl.
*B41J 2/14* (2006.01)
*B41J 2/145* (2006.01)

(52) U.S. Cl.
CPC ..... *B41J 2/145* (2013.01); *B41J 2/1404* (2013.01); *B41J 2/14145* (2013.01)

(58) Field of Classification Search
USPC ..... 347/40, 42, 47, 54, 56
See application file for complete search history.

(56) References Cited

U.S. PATENT DOCUMENTS

| | | | | |
|---|---|---|---|---|
| 6,045,214 | A * | 4/2000 | Murthy et al. | 347/47 |
| 6,158,843 | A * | 12/2000 | Murthy et al. | 347/47 |
| 7,287,847 | B2 | 10/2007 | Fujii et al. | |
| 7,300,596 | B2 | 11/2007 | Murayama et al. | |
| 7,523,553 | B2 | 4/2009 | Ohsumi et al. | |
| 7,628,469 | B2 | 12/2009 | Inoue | |

(Continued)

FOREIGN PATENT DOCUMENTS

| | | | |
|---|---|---|---|
| CN | 102963127 | A | 3/2013 |
| EP | 0 707 965 | A2 | 4/1996 |

(Continued)

OTHER PUBLICATIONS

Search Report issued in European Patent Application No. 14001112.3, dated Mar. 27, 2015.

(Continued)

*Primary Examiner* — Lam Nguyen
(74) *Attorney, Agent, or Firm* — Fitzpatrick, Cella, Harper & Scinto

(57) ABSTRACT

A liquid ejection head includes a substrate which has an energy-generating element that generates energy to be utilized for ejecting a liquid, and a supply orifice for supplying the liquid to the energy-generating element; and an ejection orifice forming member that has a plurality of ejection orifices through which the liquid is ejected, and at least one beam-like projection which projects toward the substrate and extends along an array direction of the ejection orifices at a position corresponding to the supply orifice. A sectional area perpendicular to the array direction of the ejection orifices at the central part of the beam-like projection in the array direction of the ejection orifices is larger than a sectional area in the direction perpendicular to the array direction of the ejection orifices at both ends of the beam-like projection in the array direction.

16 Claims, 9 Drawing Sheets

(56) References Cited

U.S. PATENT DOCUMENTS

| | | | | |
|---|---|---|---|---|
| 7,905,576 | B2 * | 3/2011 | Kusunoki | 347/56 |
| 8,148,049 | B2 | 4/2012 | Murayama et al. | |
| 8,152,276 | B2 | 4/2012 | Murayama et al. | |
| 8,191,260 | B2 | 6/2012 | Kato et al. | |
| 8,286,351 | B2 | 10/2012 | Edamatsu et al. | |
| 8,596,759 | B2 | 12/2013 | Chida et al. | |
| 8,827,424 | B2 | 9/2014 | Fukai et al. | |
| 2007/0242108 | A1 | 10/2007 | Inoue | |
| 2009/0102893 | A1 | 4/2009 | Tatsumi et al. | |
| 2009/0303289 | A1 * | 12/2009 | Tagawa et al. | 347/47 |
| 2012/0013682 | A1 | 1/2012 | Chida et al. | |

FOREIGN PATENT DOCUMENTS

| | | | |
|---|---|---|---|
| JP | 09-323420 | A | 12/1997 |
| JP | 2000-158657 | A | 6/2000 |
| JP | 2007-283501 | A | 11/2007 |

OTHER PUBLICATIONS

Office Action in Chinese Patent Application No. 201410147939.0, dated Jul. 15, 2015.

* cited by examiner

LIQUID EJECTION HEAD

BACKGROUND OF THE INVENTION

1. Field of the Invention

The present invention relates to a liquid ejection head for ejecting a liquid such as an ink.

2. Description of the Related Art

Requests for the enhancement of a recording speed and an image quality of an ink jet printer have progressively increased, and resulting liquid ejection heads tend to have a higher density and an elongated size. As a dot density of the liquid ejection head is enhanced from a conventional 600 dpi to 1,200 dpi, a sectional area of a flow channel wall which constitutes a flow channel of an ink tends to decrease and a mechanical strength of an ejection orifice forming member tends to be lowered. For this reason, it is notably concerned that the ejection orifice forming member tends to be easily deformed by stress. In addition, rigidity against the stress is relatively lowered in a central part in an array direction of a plurality of ejection orifices, in which the volume of the ejection orifice forming member is small, compared to that in both ends in the array direction of the ejection orifices. For this reason, as the liquid ejection head is elongated, the central part in the array direction of the ejection orifices becomes easily affected by the stress, and there is concern that the ejection orifice forming member is deformed. In the case where the deformation has occurred in the ejection orifice forming member, the ejection orifice is deformed, and it becomes difficult for a droplet to be stably landed at a desired position through the ejection orifice. As a result, the record quality of a recorded article results in being lowered.

As a measure of suppressing such a deformation of the ejection orifice forming member, Japanese Patent Application Laid-Open No. 2000-158657 discloses a configuration in which a beam-like projection is provided in the ejection orifice forming member at a position which faces an ink supply orifice, thereby enhancing the rigidity of the ejection orifice forming member. When the rigidity of the ejection orifice forming member is enhanced, an effect of suppressing the deformations of the ejection orifice forming member and the ejection orifice is obtained.

In addition, Japanese Patent Application Laid-Open No. 2007-283501 discloses a configuration in which a reinforcing rib that extends from the beam-like projection toward the ejection orifice and comes in contact with the substrate is formed integrally with the beam-like projection, thereby enhancing the rigidity against an external force and suppressing the deformations of the ejection orifice forming member and the ejection orifice.

However, the configuration disclosed in Japanese Patent Application Laid-Open No. 2000-158657 has the following problem. In the central part in the array direction of the ejection orifices in the ejection orifice forming member, a volume occupied by the ejection orifice forming member is relatively small compared to that in both the ends, and it is concerned that the central part tends to be easily deformed. This concern much more remarkably appears as the ejection orifice forming member is elongated. This is because when the beam-like projection is provided in the ejection orifice forming member, the rigidity is uniformly enhanced in the whole ejection orifice forming member, and accordingly it is still concerned to originate in a difference of the rigidity between both ends and the central part in the array direction of the ejection orifices.

In addition, when the volume of the beam-like projection is sufficiently increased so as not to cause the deformation of the ejection orifice forming member, a position onto which the stress acts results in moving to a portion at which the rigidity is relatively low, in other words, to an interface between the substrate and the ejection orifice forming member. As a result, it is concerned that the ejection orifice forming member is separated from the substrate. Accordingly, it is difficult to solve a problem that the record quality of the recorded article is lowered.

In addition, the configuration disclosed in Japanese Patent Application Laid-Open No. 2007-283501 has the following problem. Even in the structure having a reinforcing rib, the ejection orifice forming member still has a smaller volume in the central part in the array direction of the ejection orifices compared to that in both the ends in the array direction, and tends to easily cause the deformation in the central part. This tendency much more remarkably appears as the ejection orifice forming member is elongated. The configuration disclosed in Japanese Patent Application Laid-Open No. 2007-283501 cannot resolve such a tendency that the central part in the array direction of the ejection orifices tends to be easily deformed, which much more remarkably appears as the length of the ejection orifice forming member increases.

SUMMARY OF THE INVENTION

In order to achieve the above described objects, a liquid ejection head includes: a substrate which has an energy-generating element that generates energy to be utilized for ejecting a liquid, and a supply orifice for supplying the liquid to the energy-generating element; and an ejection orifice forming member that has a plurality of ejection orifices through which the liquid is ejected, and at least one beam-like projection which projects toward the substrate and extends along an array direction of the ejection orifices at a position corresponding to the supply orifice; wherein a sectional area perpendicular to the array direction of the ejection orifices in the central part of the beam-like projection in the array direction of the ejection orifices is larger than a sectional area in the direction perpendicular to the array direction of the ejection orifices in both ends of the beam-like projection in the array direction.

A liquid ejection head includes: a substrate which has an energy-generating element that generates energy to be utilized for ejecting a liquid, and a supply orifice for supplying the liquid to the energy-generating element; and an ejection orifice forming member that has a plurality of ejection orifices through which the liquid is ejected, a beam-like projection which projects toward the substrate and extends along an array direction of the ejection orifices at a position corresponding to the supply orifice, and a plurality of reinforcing ribs which project from the beam-like projection toward the ejection orifices and are in contact with the substrate; wherein a volume of the reinforcing ribs which are arranged in the central part of the beam-like projection in the array direction of the ejection orifices is larger than a volume of the reinforcing ribs which are arranged in the ends of the beam-like projection in the array direction of the ejection orifices.

A liquid ejection head includes: a substrate which has a plurality of energy-generating elements which generate energy to be utilized for ejecting a liquid, and a plurality of supply orifices for supplying the liquid to the energy-generating elements; and an ejection orifice forming member that has a plurality of ejection orifices through which the liquid is ejected, a beam-like projection which projects toward the substrate and extends along an array direction of the ejection orifices at a position corresponding to the supply orifices, and a plurality of columnar projections which project toward the substrate in between the plurality of supply orifices; wherein a sectional area perpendicular to the array direction of the ejection orifices in the central part of the beam-like projection in the array direction of the ejection orifices is larger than a sectional area in the direction perpendicular to the array direction of the ejection orifices in both ends of the beam-like projection in the array direction.

Further features of the present invention will become apparent from the following description of exemplary embodiments with reference to the attached drawings.

BRIEF DESCRIPTION OF THE DRAWINGS

FIG. 1A is a perspective view illustrating a recording element substrate; FIG. 1B is a perspective view illustrating the liquid ejection head.

FIG. 10C is a cross-sectional view taken along the line 10C-10C in FIG. 10A.

DESCRIPTION OF THE EMBODIMENTS

Preferred embodiments of the present invention will now be described in detail in accordance with the accompanying drawings.

A liquid ejection head of the embodiment is a liquid ejection head which ejects a liquid such as an ink, and will be described as a liquid ejection head of ejecting the ink (ink-jet liquid ejection head), in the following embodiments.

The liquid ejection head can be mounted on an apparatus such as a printer, a copying machine, a facsimile machine having a communication system, and a word processor having a printer section, and an industrial recording apparatus which is combined complexly with various processing apparatuses. Thus employed liquid ejection head can record an image on various materials to be recorded thereon such as paper, yarn, fiber, leather, metal, plastic, glass, wood and ceramics.

"Recording" to be used in the present specification shall mean an operation of forming not only a character, a figure and the like, but also an image such as a pattern, which does not have meanings, onto a material to be recorded.

Furthermore, "ink" should be widely interpreted, and shall include a liquid which is attached onto the material to be recorded to form an image, a design, a pattern and the like or to process the material to be recorded, or which is supplied for the processing of the ink or the material to be recorded. Here, the processing of the ink or the material to be recorded means, for instance, the enhancement of fixability by the solidification or insolubilization of a coloring material in the ink to be attached onto the material to be recorded, the enhancement of a recording quality or color generation property, the enhancement of image durability, and the like.

A basic structure of the liquid ejection head of the present embodiment will be described below, with referring to a recording element substrate having a general structure as an example, for the sake of convenience of description.

The structure of an essential part of the liquid ejection head relating to the feature of the present invention will be described below with reference to FIG. 2 and subsequent drawings.

Figure 1A:
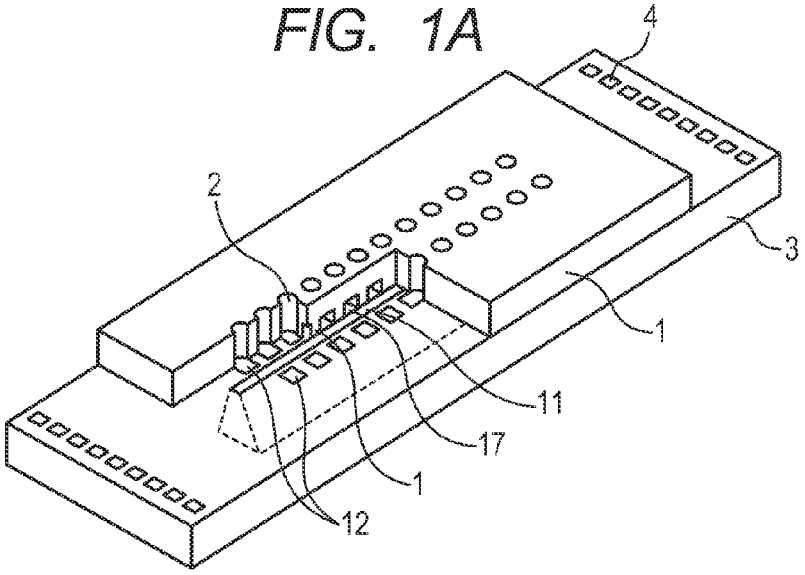
FIGS. 1A and 1B are views illustrating a configuration of a liquid ejection head according to the present embodiment.

FIG. 1A is a perspective view illustrating a general recording element substrate 6. In a liquid ejection head 5 of the embodiment, the recording element substrate 6 is formed which includes a substrate 3 having an energy-generating element 12, and an ejection orifice forming member 1 that is formed on the substrate 3. The ejection orifice forming member 1 has a plurality of through-holes therein each of which is provided so as to penetrate a facing portion that faces the surface of the substrate 3, on which the energy-generating element 12 is provided. Such an ejection orifice forming member 1 is made of a resinous material, and has the plurality of through-holes collectively provided therein by using a photolithographic technology or an etching technology.

Here, in the ejection orifice forming member 1, the through-hole is provided which makes a liquid chamber opened in a position that faces the principal surface of the substrate 3 on which the energy-generating element 12 is provided communicate with the ejection orifice provided in the side at which the ink is ejected. The plurality of through-holes are used as a plurality of ejection orifices 2 which eject ink therethrough by utilizing energy generated by the energy-generating elements 12, and the plurality of ejection orifices are arrayed in a line at a predetermined pitch to constitute a row of the ejection orifices.

An electrothermal transducer (heater) and a piezoelectric element (piezo element) may be usable as the usable energy-generating element 12 which the substrate 3 has. The plurality of energy-generating elements 12 is arrayed at the position as to face the row of the ejection orifices, and the plurality of energy-generating elements 12 form two rows of the elements. An ink supply orifice 11 is provided in a position between the two rows of the elements so as to penetrate the substrate 3, as a supply orifice which supplies ink to the energy-generating element 12. There are forms in the ink supply orifice 11, which include a form in which a plurality of ink supply orifices are provided on the same substrate 3, and a form in which the ink supply orifice has a plurality of independent supply orifices arrayed along the row of the ejection orifices, in addition to a form in which one ink supply orifice is provided on the same substrate 3.

Furthermore, the ejection orifice forming member 1 comes in contact with the substrate 3, and thereby an ink flow channel 17 for making the ink supply orifice communicate with the ejection orifice is formed in a space between the ejection orifice forming member and the substrate. In the present embodiment, the flow channel is formed on the surface of the ejection orifice forming member, which faces the substrate.

In addition, in the present embodiment, a beam-like projection 10 which extends in the same direction as the array direction of the ejection orifices is provided in the side of the ink flow channel of the ejection orifice forming member 1. A connection terminal 4 for supplying an electric power to the energy-generating elements 12 is provided on the recording element substrate 6.

Figure 1B:
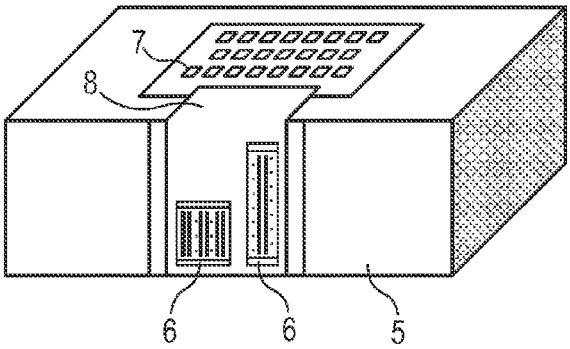

FIG. 1B illustrates an outline of the configuration of the liquid ejection head 5. The recording element substrate 6 is bonded to the liquid ejection head 5, and performs an operation of ejecting ink when an electric power has been supplied to the recording element substrate 6 from a contact pad 7 through a flexible wiring board 8.

Figure 3A:
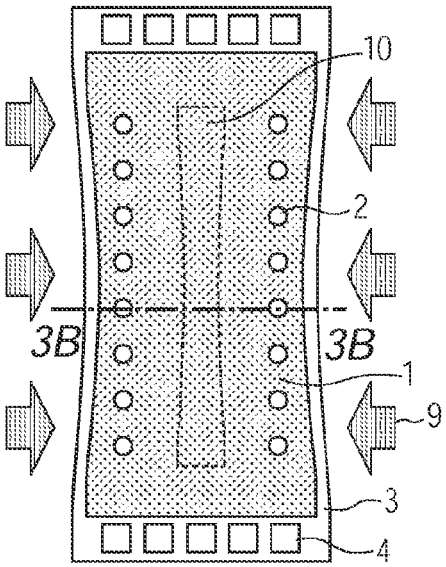
FIG. 3A is a plan view illustrating a state in which a conventional ejection orifice forming member is deformed by a stress.
Figure 3C:
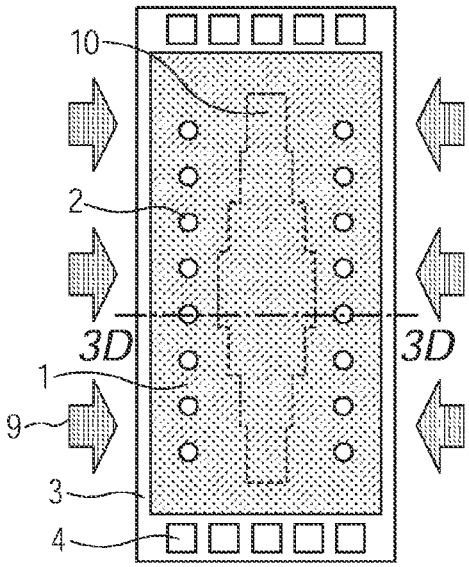
FIG. 3C is a plan view illustrating a state in which the deformation of an ejection orifice forming member of the present embodiment by a stress is suppressed.
Figure 3B:
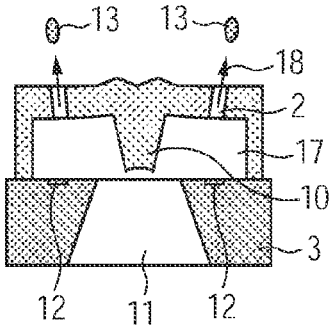
FIG. 3B is a cross-sectional view that is taken along the line 3B-3B in FIG. 3A and illustrates the state in which the conventional ejection orifice forming member is deformed by the stress.
Figure 3D:
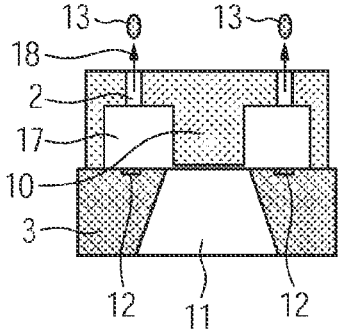
FIG. 3D is a cross-sectional view that is taken along the line 3D-3D in FIG. 3C and illustrates the state in which the deformation of the ejection orifice forming member of the present embodiment by the stress is suppressed.

FIG. 3A to FIG. 3D are views for describing an effect in the embodiment. In the conventional structure illustrated in FIG. 3A, the deformation by the stress tends to easily occur in the central part of the ejection orifice forming member in the array direction of the ejection orifices. Because of this, an ejecting direction 18 of a droplet 13 results in deviating to the outer periphery side of the ejection orifice forming member, from the position at which the droplet 13 is desired to land, which ought to be determined by the position of the energy-generating element 12, as is illustrated in FIG. 3B. Then, in the embodiment, as is illustrated in FIG. 3C, a width which is perpendicular to the array direction of the ejection orifices and is parallel to the principal surface of the ejection orifice forming member (hereinafter referred to simply as "width") is set to be larger in the central part of the beam-like projection 10 in the array direction of the ejection orifices than in both the ends. Thereby, a sectional area of the beam-like projection in a direction perpendicular to the array direction of the ejection orifices is set to be relatively large, the occurrence of the deformation in the central part of the ejection orifice forming member in the array direction of the ejection orifices is suppressed, and a stress 9 is also dispersed toward the whole of the recording element substrate 6. Thereby, as is illustrated in FIG. 3D, the droplet 13 is enabled to fly in a direction perpendicular to the principal surface of the energy-generating element 12. As a result, the droplet 13 is enabled to land at a desired position.

Figure 2:
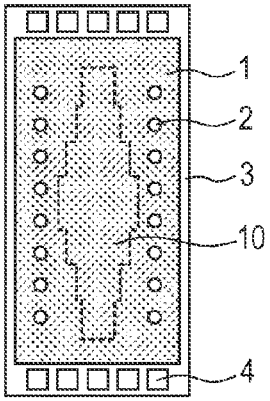
FIG. 2 is a plan view illustrating a representative structure of the present embodiment.

FIG. 2 illustrates a representative structure of the liquid ejection head of the present embodiment. In the conventional structure, the width of the beam-like projection 10 is uniform in the array direction of the ejection orifices, but in the present invention, the width of the beam-like projection is set to be larger in the central part in the array direction of the ejection orifices than in both the ends. As for the width of the beam-like projection 10, the width in the central part in the array direction of the ejection orifices, at which the concern that the deformation may occur is highest, is preferably set to be largest.

First Embodiment

A liquid ejection head of a first embodiment will be described below with reference to FIG. 4A to FIG. 4D. In a basic configuration of the first embodiment, in which one ink supply orifice 11 is provided on a substrate 3 having a dot density of 600 dpi, one beam-like projection 10 is provided for the one ink supply orifice 11. In the configuration having the beam-like projection 10, a volume of an ejection orifice forming member 1 is larger than that in the configuration having no beam-like projection 10, and the rigidity of the ejection orifice forming member 1 is enhanced. However, in the conventional structure having the beam-like projection 10, the width of the beam-like projection 10 is made uniform in the whole recording element substrate, and the central part of the ejection orifice forming member in the array direction of the ejection orifices is weak against an external force, compared to the structure illustrated in the first embodiment.

Figure 4A:
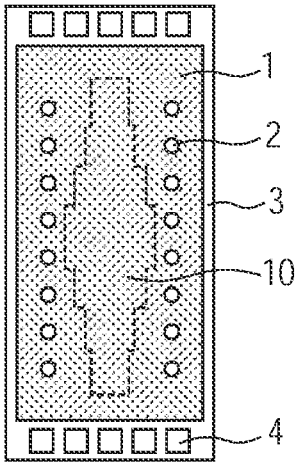
FIGS. 4A, 4B, 4C and 4D are perspective plan views illustrating a first embodiment.

Then, a configuration illustrated in FIG. 4A is a configuration in which one beam-like projection 10 is provided for the one ink supply orifice 11, and the beam-like projection is formed so that the width gradually increases step by step toward the central part from both the ends in the array direction of the ejection orifices, according to the arrangement pitch of each ejection orifice 2. By the beam-like projection having the width gradually increasing step by step according to the pitch of the ejection orifices 2, the accuracy can be enhanced in a region of the ejection orifices 2, to which a reinforcing effect is given. In addition, by the beam-like projection of which the width in the central part in the array direction of the ejection orifices in which the deformation by the stress tends to most easily occur is set to be largest, the stress 9 is dispersed toward the whole of the recording element substrate 6, and accordingly the occurrence of the deformation and the peeling of the ejection orifice forming member 1 can be suppressed. By the beam-like projection 10 having the width gradually increasing step by step according to the pitch of the ejection orifices 2, a reinforcing effect is enabled to be individually given to the ejection orifices 2. Accordingly, the ejection orifice forming member 1 can be more appropriately reinforced against the deformation thereof.

Figure 4B:
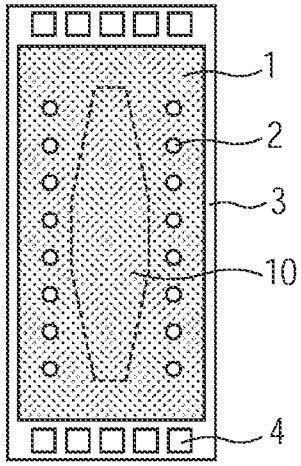

A structure illustrated in FIG. 4B has a configuration in which one beam-like projection 10 is provided for the one ink supply orifice 11, and the width of the beam-like projection is linearly changed so as to increase toward the central part from both the ends in the array direction of the ejection orifices. The beam-like projection thus having the width linearly changed so as to increase toward the central part from both the ends in the array direction of the ejection orifices can decrease a concern for the deformation caused by the stress 9, which tends to be easily concentrated on the corner of the beam-like projection.

Figure 4C:
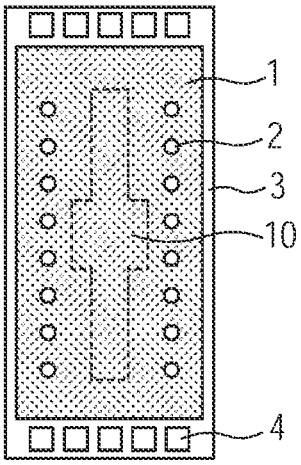

The structure illustrated in FIG. 4C has a configuration in which one beam-like projection 10 is provided for the one ink supply orifice 11, and the width of the beam-like projection is formed to be large in the central part of the beam-like projection in the array direction of the ejection orifices so that a quadrangular shape is formed there. The beam-like projection having a large width only in the central part in the array direction of the ejection orifices can limit a region, to which the reinforcing effect is given, only to the central part of the ejection orifice forming member in the array direction of the ejection orifices.

Figure 4D:
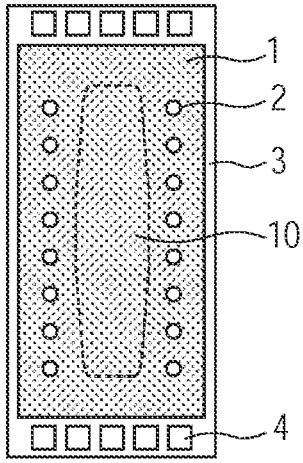

A structure illustrated in FIG. 4D has a configuration in which one beam-like projection 10 is provided for the one ink supply orifice 11, and the width of the beam-like projection is increased toward the central part from both the ends in the array direction of the ejection orifices so that the side face of the beam-like projection forms an arc shape. Thus, the beam-like projection has the width formed so as to continuously increase in the array direction of the ejection orifices, and thereby the beam-like projection has no corner portion formed therein compared to the configuration illustrated in FIG. 4B. Because of this, it may be possible to further reduce the deformation starting from the interface between the substrate and the ejection orifice forming member due to the stress 9.

The above described configuration examples are a part of the first embodiment, and it is apparent that a similar shape which easily comes to mind is also included in the present invention. In addition, in the present embodiment, the width of the beam-like projection 10 was described, but the width is not limited to the width of the beam-like projection, and the form may be such a form that the sectional area of the beam-like projection increases. The present invention includes also a structure in which the thickness of the beam-like projection (hereinafter referred to simply as "thickness") in a direction perpendicular to the open face of the ink supply orifices (thickness direction of ejection orifice forming member) is differentiated between both the ends and the central part in the array direction of the ejection orifices. Specifically, a similar effect is obtained also when the amount of projection of the beam-like projection toward the substrate is set so as to be larger in the central part in the array direction of the ejection orifices than in the end in the array direction of the ejection orifices.

(Manufacturing Method)

The liquid ejection head of each of the above described embodiments can be manufactured with a general method for manufacturing the liquid ejection head 5. The manufacturing method will be described below.

Firstly, a positive type photosensitive resin dissolvable so as to form a mold is applied onto the substrate 3 having the energy-generating element 12 formed therein with the use of a spin coating method. Then, a desired pattern is formed by exposing the thus formed resin to light with the use of an exposure mask, and a desirable shape as the shape which becomes a pattern of the ink flow channel 17 is formed by development. Next, a negative type resist which constitutes the ejection orifice forming member 1 is applied onto the substrate 3 and the mold. Then, a pattern of the ejection orifices 2 is formed on the negative type resist by light exposure with the use of an exposure mask for the ejection orifices, and then the negative type resist is subjected to PEB (heat treatment) and development. Thereby, the ejection orifices 2 are formed. Finally, the shape is removed and the ink flow channel 17 is formed. Thereby, the liquid ejection head 5 is completed.

The shape of the beam-like projection 10, which is the feature of the present invention, is determined by the patterning for the mold in the above described manufacturing method. In other words, all the embodiments can be carried out by appropriately changing the mask pattern of the exposure mask for the mold according to the embodiment.

Second Embodiment

A second embodiment will be described below with reference to FIG. 5A to FIG. 6D. In a basic configuration of the second embodiment, one ink supply orifice 11 is provided on a substrate 3 having a dot density of 600 dpi, and two beam-like projections 10 are provided for the one ink supply orifice 11. Thus provided two beam-like projections 10 effectively absorb the stress 9, and can also suppress the peeling of the ejection orifice forming member 1 itself, in addition to the configuration of having one beam-like projection 10 shown in the first embodiment. In the conventional structure, each of the two beam-like projections 10 is formed so as to have a uniform width along the array direction of the ejection orifices, and the central part in the array direction of the ejection orifices is weaker against an external force than in both ends in the array direction, when having been compared to the structure illustrated in the second embodiment.

Figure 5A:
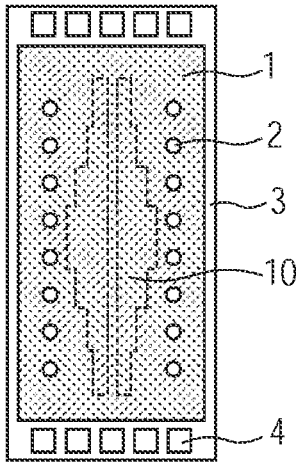
FIGS. 5A, 5B, 5C and 5D are perspective plan views illustrating a second embodiment.

Then, in the configuration illustrated in FIG. 5A, the two beam-like projections 10 are provided for the one ink supply orifice 11, and the beam-like projection 10 is formed so that the width gradually increases step by step toward the central part from both ends of the beam-like projection 10 in the array direction of the ejection orifices according to the pitch of the ejection orifices 2. By the beam-like projection 10 having the width gradually increasing step by step according to the pitch of the ejection orifices 2, the accuracy can be enhanced in a region to which a reinforcing effect is given.

In addition, by the beam-like projection 10 of which the width in the central part in the array direction of the ejection orifices, in which the deformation by the stress tends to most easily occur, is set to be largest, the stress 9 is dispersed toward the whole of the recording element substrate 6, and accordingly the occurrence of the deformation and the peeling of the ejection orifice forming member 1 can be suppressed. By the beam-like projection 10 having the width gradually increased step by step according to the pitch of the ejection orifices 2, a reinforcing effect is enabled to be individually given to the plurality of ejection orifices 2. Accordingly, the ejection orifice forming member 1 can be more appropriately reinforced against the deformation thereof.

In addition, a linear groove is formed between the two beam-like projections 10, along the array direction of the ejection orifices. The groove can absorb the stress, and accordingly shows also an effect of suppressing the peeling of the ejection orifice forming member 1.

Figure 5B:
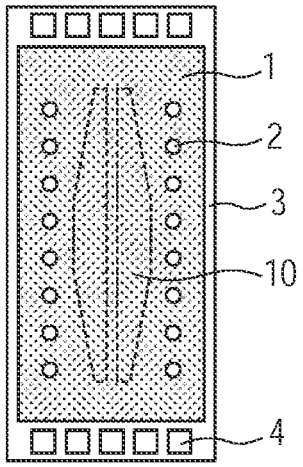

A configuration illustrated in FIG. 5B is a configuration in which the two beam-like projections 10 are provided for the one ink supply orifice 11, and the width of the beam-like projection 10 is linearly changed so as to gradually increase toward the central part from both ends in the array direction of the ejection orifices. The beam-like projection thus having the width linearly changed so as to increase toward the central part from both the ends in the array direction of the ejection orifices can decrease such a concern that the deformation may occur which starts from the interface between the substrate and the ejection orifice forming member due to the stress 9.

Figure 5C:
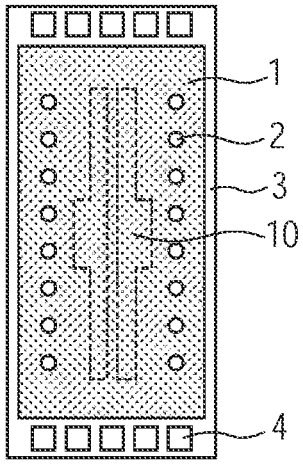

The configuration illustrated in FIG. 5C is a configuration in which the two beam-like projections 10 are provided for the one ink supply orifice 11, and the width of the beam-like projection 10 is formed to be large in the central part in the array direction of the ejection orifices so that a quadrangular shape is partially formed there. The beam-like projection 10 having a large width only in the central part in the array direction of the ejection orifices can limit a region to which the reinforcing effect is given, only to the central part in the array direction of the ejection orifices.

Figure 5D:
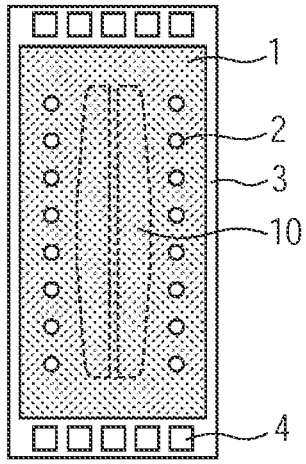
Figure 6A:
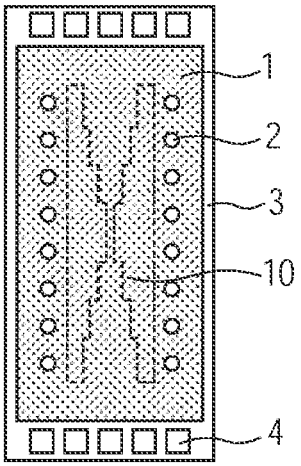
FIGS. 6A, 6B, 6C and 6D are perspective plan views illustrating the second embodiment.
Figure 6B:
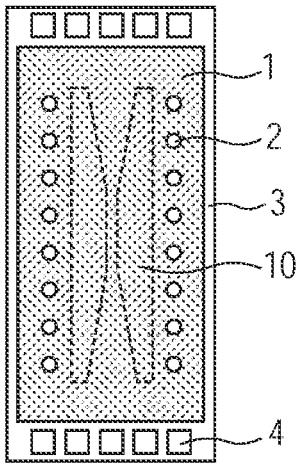
Figure 6C:
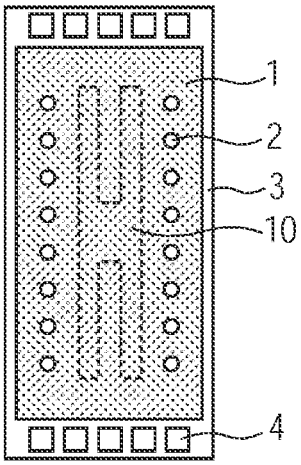
Figure 6D:
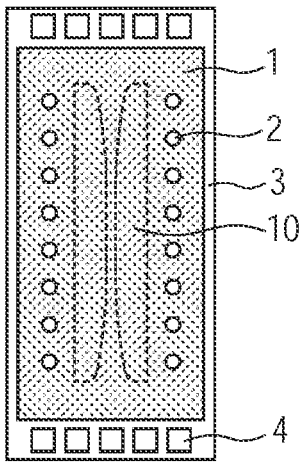

A configuration illustrated in FIG. 5D is a configuration in which the two beam-like projections 10 are provided for the one ink supply orifice 11, and the width of the beam-like projection 10 is increased toward the central part from both ends in the array direction of the ejection orifices so that the side face of the beam-like projection 10 forms an arc shape. Thus, the beam-like projection has the width continuously increasing in the array direction of the ejection orifices, and thereby the beam-like projection has no corner portion formed therein compared to the structure illustrated in FIG. 5B. Because of this, it may be possible to further reduce the deformation starting from the interface between the substrate and the ejection orifice forming member due to the stress 9.

The configurations illustrated in FIG. 6A to FIG. 6D are configurations in which the two beam-like projections 10 are provided for the one ink supply orifice 11, and the width of the beam-like projection 10 is set to be large in the central part in the array direction of the ejection orifices. In addition, in these configurations, the two beam-like projections have each equal distance between the end of beam-like projection 10 in the array direction and the ejection orifice which is the closest to this end. By thus formed two beam-like projections having such a shape, an effect of equalizing a flowing way of the ink to the ejection orifice 2 and a rear resistance when the ink is ejected in all of the ejection orifices 2 is obtained, in addition to the effect of the configurations illustrated in FIG. 5A to FIG. 5D, and accordingly the liquid ejection head can further stably perform the ejecting operation.

The above described each configuration example is a part of the second embodiment, and it is apparent that a similar shape which easily comes to mind is also included in the present invention. In addition, in the present embodiment, the size of the width of the beam-like projection 10 is described, but such a structure is also included in the present invention that the thickness of the beam-like projection in the array direction of the ejection orifices is differentiated between both the ends and the central part.

Third Embodiment

A third embodiment will be described below with reference to FIG. 7A to FIG. 7C. A basic configuration of the third embodiment has a reinforcing rib 14 which is formed integrally with the beam-like projection 10, extends from the beam-like projection 10 toward an ejection orifice 2 in a width direction of the beam-like projection 10, and comes in contact with the substrate 3. Thereby, the liquid ejection head 5 can enhance the rigidity of the ejection orifice forming member 1, in particular, against a stress 9 which is applied to the ejection orifice forming member 1 in the thickness direction.

On the other hand, in the conventional structure, the reinforcing ribs 14 are arranged so as to have a fixed pitch and a uniform length in the array direction of the ejection orifices. In the ejection orifice at which the reinforcing rib 14 is not arranged, a nozzle filter is provided at a position which has an equal distance from the ejection orifice so that a flowing way of the ink and a rear resistance when the ink is ejected become constant. In these structures, the ejection orifice forming member is weak against the stress 9 which causes the deformation in the central part in the array direction of the ejection orifices.

Figure 7A:
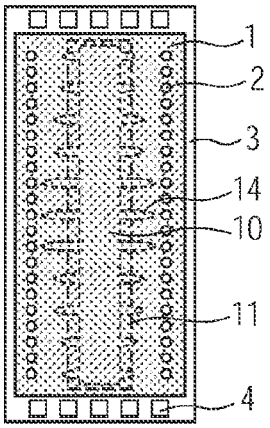
FIGS. 7A, 7B and 7C are perspective plan views illustrating a third embodiment.

A configuration illustrated in FIG. 7A is a configuration example in which the length of the reinforcing rib 14 in the central part in the array direction of the ejection orifices is set to be longer than that of the reinforcing rib in both ends. The structure formed in such a way shows a similar effect to the structure in which the width in the central part of the beam-like projection in the array direction of the ejection orifices is set to be large, which tends to be most easily deformed in the array direction of the ejection orifices, and can suppress a local deformation of the ejection orifice forming member 1.

Figure 7B:
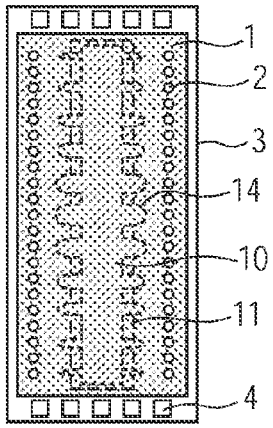

The configuration illustrated in FIG. 7B is a view illustrating a configuration example in which the width (thickness) of the reinforcing rib 14 in the central part in the array direction of the ejection orifices is set to be larger than the width of the reinforcing rib in both ends. The reinforcing rib 14 which comes in contact with the substrate 3 and has a larger width further enhances the rigidity in the central part in the array direction of the ejection orifices, which tends to be most easily deformed in the array direction of the ejection orifices, than that in the configuration illustrated in FIG. 7A, and can further suppress the local deformation.

Figure 7C:
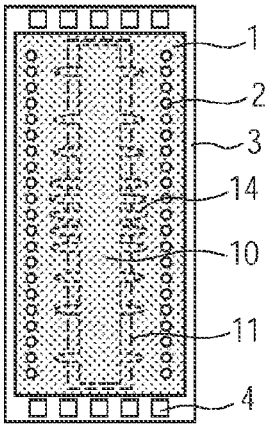

In the configuration illustrated in FIG. 7C, the pitch of the reinforcing ribs 14 provided in the central part in the array direction of the ejection orifices is set to be smaller than the pitch of the reinforcing ribs provided in both ends. The volume of the plurality of the reinforcing ribs 14 occupied per pitch of the ejection orifices in the central part of the ejection orifice forming member in the array direction of the ejection orifices is set to be larger, which thereby enhances the rigidity, shows an effect of suppressing the deformation of the ejection orifice forming member, and further can equalize the rear resistance when the ink is ejected, which acts on the ejection characteristics. As a result, the liquid ejection head can further stably perform the ejecting operation.

The above described configuration examples are a part of the third embodiment, and it is apparent that a similar shape which easily comes to mind is also included in the present invention. In addition, in the third embodiment, the two-dimensional shape of the reinforcing rib 14 has been described, but such a structure is also included in the present invention that the thicknesses of the reinforcing ribs in the thickness direction of the ejection orifice forming member (amounts of projection) are differentiated between both ends and the central part in the array direction of the ejection orifices.

Fourth Embodiment

A fourth embodiment will be described below with reference to FIG. 8A and FIG. 8B. In order to enhance a speed of recording and a definition, it is required to enhance dot density to 1,200 dpi. However, when the density of the ejection orifices 2 is enhanced, a sectional area of a flow channel wall which constitutes a flow channel decreases, rigidity against the stress 9 is lowered, and the ejection orifice forming member is in a state that the deformation or peeling thereof tends to easily occur. In a conventional structure, each of the two beam-like projections 10 is formed so as to have a uniform width regardless of the dot density, and the row of the ejection orifices of 1,200 dpi, in which the sectional area of the flow channel wall decreases, is further weak against the stress 9, when having been compared to that in the structure illustrated in the fourth embodiment.

Figure 8A:
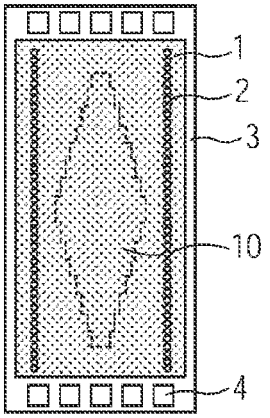
FIGS. 8A and 8B are perspective plan views illustrating a fourth embodiment.

The configuration illustrated in FIG. 8A is a configuration in which the one ink supply orifice 11 is provided on a substrate 3 having a dot density of 1,200 dpi, and to which the same thought as that in the first embodiment is applied. By the beam-like projection having the width gradually increasing step by step according to the pitch of the ejection orifices 2, the accuracy can be enhanced in a region of the ejection orifices 2, which is an object to which a desired reinforcing effect is given, even in the case where the density of the ejection orifices has been enhanced. In addition, by the beam-like projection of which the width in the central part of the ejection orifice forming member in the array direction of the ejection orifices, in which the deformation by the stress 9 tends to most easily occur, is set to be largest, the stress 9 is dispersed toward the whole of the recording element substrate 6, and accordingly the occurrence of the deformation and the peeling of the ejection orifice forming member 1 can be suppressed. By the beam-like projection 10 which is formed so as to have the width gradually increasing step by step according to the pitch of the ejection orifices 2, a reinforcing effect is enabled to be individually given to the ejection orifices 2. Accordingly, even in the case where the dot density has been enhanced, the ejection orifice forming member 1 can be appropriately reinforced against the deformation thereof by setting the space between the ejection orifices to be further finer according to the pitch of the ejection orifices 2.

Figure 8B:
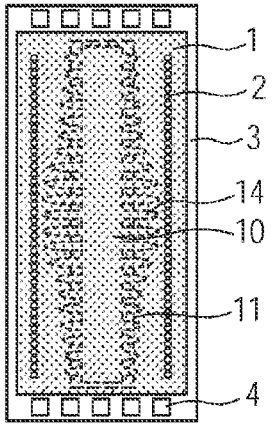

The configuration illustrated in FIG. 8B is a configuration in which the one ink supply orifice 11 is provided on the substrate 3 having the dot density of 1,200 dpi, and to which the same thought as that in the third embodiment is applied. The pitch of the ejection orifices 2 is more narrowed than that in the first embodiment, and the pitch of the reinforcing ribs is set to be still finer so as to correspond to the pitch of the ejection orifices 2 toward the central part from both ends in the array direction of the ejection orifices. In addition, the length of the reinforcing rib 14 in the central part is increased compared to that in both ends of the beam-like projection in the array direction of the ejection orifices, thereby suppressing the deformation which occurs in the central part of the ejection orifice forming member in the array direction of the ejection orifices due to the stress 9. Thus, when the fourth embodiment is applied to the liquid ejection head, the reinforcing effect can be similarly given to the ejection orifice forming member, even in the configuration in which the dot density is enhanced.

The above described configuration examples are a part of the fourth embodiment, and it is apparent that a similar shape which easily comes to mind is also included in the present invention. In addition, in the present embodiment, the width of the beam-like projection 10 and the volume of the reinforcing rib 14 are described, but such a structure is also included in the present invention that the thickness of the beam-like projection and the thicknesses of the reinforcing ribs in the array direction of the ejection orifices are differentiated between both the ends and the central part.

Fifth Embodiment

A fifth embodiment will be described below with reference to FIG. 9A to FIG. 9F. There are cases where when a desired recording pattern is recorded at high density, a relatively small droplet is ejected, and when a rough pattern such as a character is recorded at high speed, a relatively large droplet is ejected. In such cases, there is the case where dot densities are differentiated between a row of ejection orifices in one side (left side in figure) of an ink supply orifice 11 and a row of ejection orifices in the other side (right side in figure) thereof. In the row of the ejection orifices in the side of a dot density of 1,200 dpi, a sectional area of the flow channel wall is small and the rigidity against the stress 9 is weak compared to that in the row of the ejection orifices having a dot density of 600 dpi, thereby resulting in becoming a factor of causing peeling and the like. In the conventional structure, the width of the beam-like projection 10 is uniform in the array direction of the ejection orifices, and the sectional area of the flow channel wall decreases along with the enhancement of the density of the ejection orifices, and accordingly the row of the ejection orifices particularly in the side of 1,200 dpi is weak against the external force compared to that in the configuration illustrated in the second embodiment.

Figure 9A:
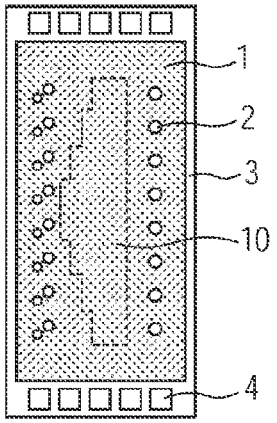
FIGS. 9A, 9B, 9C, 9D, 9E and 9F are views illustrating a fifth embodiment.
Figure 9B:
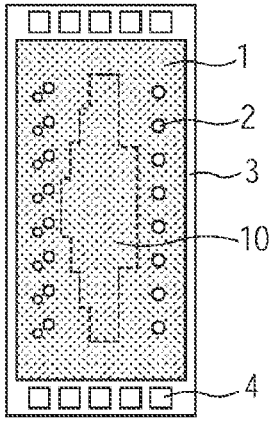

The configurations illustrated in FIG. 9A and FIG. 9B are configurations in which the one beam-like projection 10 is provided for the one ink supply orifice 11, and the width only in the side of one side face in the central part of the beam-like projection in the array direction of the ejection orifices is formed to be large. In addition, in this configuration, the side of the other side face in the central part of the beam-like projection 10 is linearly formed in the array direction of the ejection orifices. Alternatively, a volume of the central part of the beam-like projection in the array direction of the ejection orifices is more increased than the ends thereof, and is formed so as to be smaller than a volume of a step-like portion which is formed in the side of one side face that faces the row of the ejection orifices in the high density side (1,200 dpi side). The volume of the beam-like projection 10 is differentiated between each side of two rows of the ejection orifices, and thereby a balance of a relationship between the rigidity and the stress 9 of the ejection orifice forming member 1 can be adequately kept. As a result, the deformation and peeling of the ejection orifice forming member 1 can be suppressed. Thereby, even in the case where the dot densities are different between each of the two rows of the ejection orifices, a droplet 13 is enabled to stably land at a desired position.

Figure 9C:
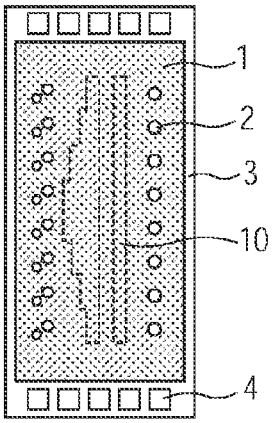
Figure 9D:
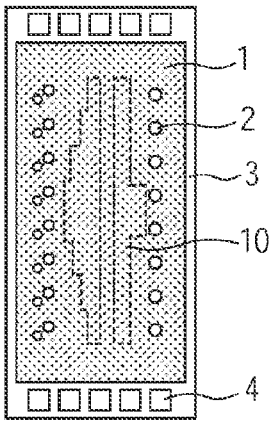

The configurations illustrated in FIG. 9C and FIG. 9D are configurations in which the two beam-like projections 10 are provided for the one ink supply orifice 11, and the width only in the side of one side face in the central part of the beam-like projection in the array direction of the ejection orifices is formed to be large. In addition, in this configuration, the side of the other side face of the beam-like projection 10 is linearly formed in the array direction of the ejection orifices. Alternatively, a volume in the side of one side face in the central part of the beam-like projection in the array direction of the ejection orifices is more increased than that in the side of the other side face thereof, and is formed so as to be smaller than a volume of a step-like portion which a beam-like projection corresponding to the ejection orifices in the high density side has.

This configuration has a linear-shaped groove formed in the beam-like projection 10 along the array direction of the ejection orifices, and thereby can suppress also the peeling of the ejection orifice forming member 1 by the groove, in addition to an effect described in the configurations illustrated in FIG. 9A and FIG. 9B. Thereby, even in the case where the dot densities are different between each of the two rows of the ejection orifices, a droplet 13 can be stably landed at a desired position.

Figure 9E:
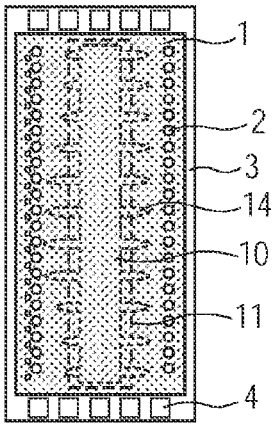
Figure 9F:
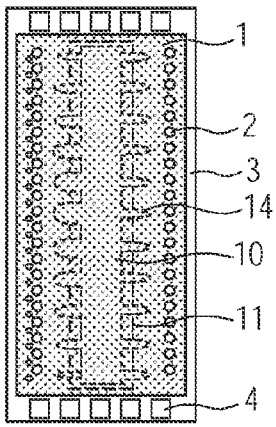

The configurations illustrated in FIG. 9E and FIG. 9F are configurations which have the reinforcing rib 14, a structure is used in which any one of a length, a sectional area and a pitch of the reinforcing ribs 14 is differentiated, in the side of the row of the ejection orifices having relatively high density, and the reinforcing ribs 14 are usually arranged at a fixed pitch, in the other side. Thus, the present invention is applied only to the side face in the high density side of the beam-like projection, and the side face in the other side of the beam-like projection is linearly formed similarly to a conventional structure. Thereby, even in the case where the dot densities are different between each of the two rows of the ejection orifices, the deformation of the ejection orifice forming member 1 is suppressed, and a droplet 13 is enabled to stably land at a desired position.

The above described configuration examples are a part of the fifth embodiment, and it is apparent that a similar shape which easily comes to mind is also included in the present invention. In addition, in the present embodiment, the width of the beam-like projection 10 and the volume of the reinforcing rib 14 are described, but such a structure is also included in the present invention that the thicknesses of the beam-like projection and the reinforcing ribs in the thickness direction of the ejection orifice forming member (amounts of projection) are differentiated between both the ends and the central part in the array direction of the ejection orifices.

Sixth Embodiment

A sixth embodiment will be described below with reference to FIG. 10A to FIG. 10E. The present embodiment has a plurality of independent ink supply orifices 15 which are arrayed along the array direction of ejection orifices, for the purpose of enhancing a speed of an ejection operation and stabilizing the ejection. A liquid ejection head having the plurality of independent ink supply orifices 15 has a configuration that ink flows into ejection orifices 2 from both sides, thereby can enhance the accuracy of a position at which a droplet 13 lands, and/or can enhance a charging speed of the ink. In such a configuration, there is almost no difference among volumes of the ejection orifice forming member 1 in the whole region of the liquid ejection head 5, but there is the case where a further large stress is applied to the central part of the ejection orifice forming member in the array direction of the ejection orifices, which originates in the shape of the recording element substrate, when being compared to the configuration having the ink supply orifice 11. In this case, it is concerned that the central part of the ejection orifice forming member in the array direction of the ejection orifices is deformed and a recording grade is lowered. FIG. 10C is a sectional view taken along the line 10C-10C in FIG. 10A. A cross-sectional area (thickness) of a plurality of columnar projections which are arrayed along the array direction of the ejection orifices is fixed between each of the independent ink supply orifices 15, and the columnar projection comes in contact with the substrate 3. Thereby, an effect of reinforcing the ejection orifice forming member itself is obtained.

Figure 10A:
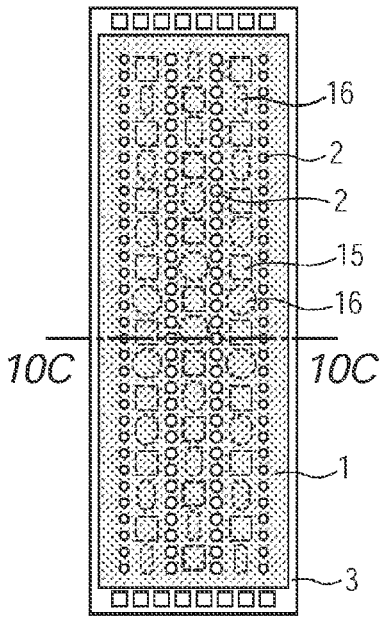
FIGS. 10A, 10B, 10C, 10D and 10E are views illustrating a sixth embodiment.
Figure 10B:
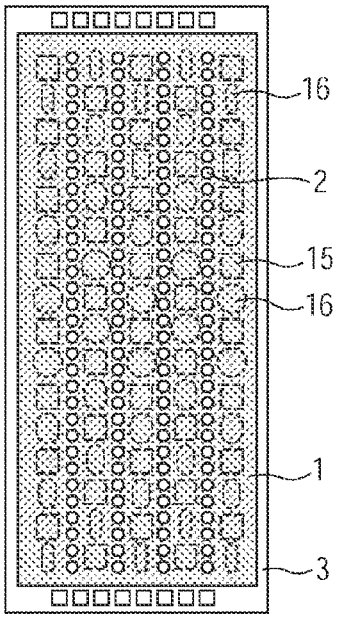
Figure 10C:
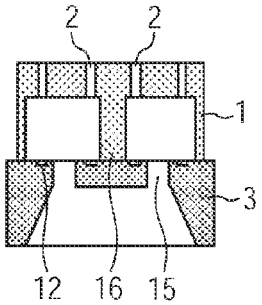

Then, in the configurations illustrated in FIG. 10A and FIG. 10B, a cross-sectional area of the columnar projection is gradually increased toward the central part from one end in the array direction of the ejection orifices, according to the pitch of the ejection orifices 2. Thereby, the rigidity in the central part of the ejection orifice forming member in the array direction of the ejection orifices is enhanced, and a reinforcing effect can be given to the ejection orifice forming member. Accordingly, the number of the ejection orifices 2 to which the reinforcing effect is given and/or a region to which the effect is given can be clarified, and the cross-sectional area and/or length of the columnar projection can be arbitrarily selected so as to cope with the deformation in the central part of the ejection orifice forming member in the array direction of the ejection orifices. As a result, the deformation can be suppressed on the whole surface of the ejection orifice forming member 1.

Figure 10D:
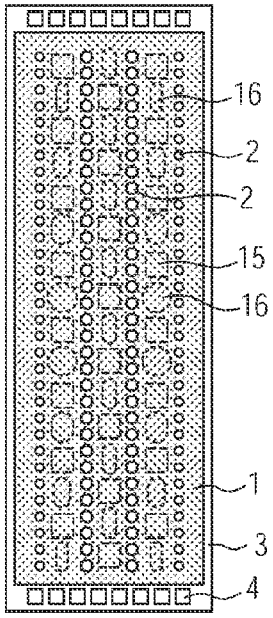
Figure 10E:
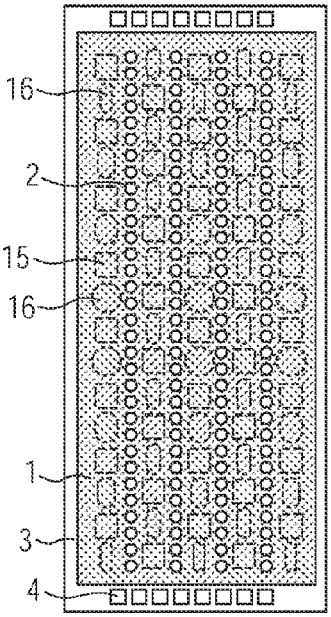

In addition, in the configurations illustrated in FIG. 10D and FIG. 10E, the cross-sectional area of the columnar projection 16 is set to be relatively large only in the row of the independent ink supply orifices in the outermost peripheral side of the recording element substrate. This configuration is effective when there is such a high concern that the outer peripheral part of the ejection orifice forming member is deformed, which is perpendicular to the array direction of the ejection orifices in the recording element substrate, and the deformation can be suppressed in the whole region of the recording element substrate 6.

As described above, when the deformations of the ejection orifice forming member 1 and the ejection orifice 2 are suppressed, high quality recording can be achieved.

The above described configuration examples are a part of the sixth embodiment, and it is apparent that a similar shape which easily comes to mind is also included in the present invention. In addition, in the present embodiment, the cross-sectional area of the columnar projection 16 is described, but such a structure is also included in the present invention that the thicknesses in the thickness direction of the ejection orifice forming member (amounts of projection) are differentiated between the columnar projections arranged in both ends in the array direction of the ejection orifices and the columnar projection arranged in the central part.

Seventh Embodiment

A seventh embodiment will be described below with reference to FIG. 11A to FIG. 11F. A basic configuration of the seventh embodiment is a configuration in which a plurality of ink supply orifices 11 are provided in the same liquid ejection head 5, and is a structure in which the liquid ejection head has beam-like projections 10 or reinforcing ribs 14 so as to face the ink supply orifices 11, respectively.

The deformation tends to easily occur in each of the ink supply orifices which are arranged in both sides while sandwiching the center (hereinafter referred to simply as both sides), compared to the ink supply orifice 11 in the central side of the ejection orifice forming member. Because of this, the configurations illustrated in FIG. 11A and FIG. 11B out of the configurations illustrated in FIG. 11A to FIG. 11F are configurations in which the same thought as that in the first embodiment is applied to each of the ink supply orifices in both the sides. There is the case where the stress 9 is concentrated on the row of the ink supply orifices in the outer side of the substrate to easily cause the deformation, compared to the row of the ink supply orifices in the central side. In this case, one usual beam-like projection can be given to the row of the ink supply orifices in the central side, and beam-like projections can be given to each row of the ink supply orifices in both the sides, with the same thought as that in the first embodiment. Thereby, even in the configuration in which the plurality of ink supply orifices 11 are provided on the same liquid ejection head 5, the ejection orifice forming member 1 resists being deformed. As a result, the liquid ejection head can keep an operation of producing recorded articles of a high grade.

Figure 11A:
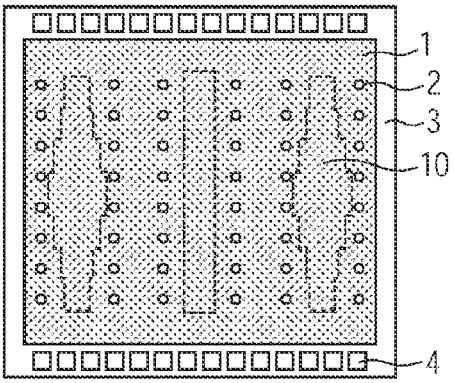
FIGS. 11A, 11B, 11C, 11D, 11E and 11F are perspective plan views illustrating a seventh embodiment.
Figure 11B:
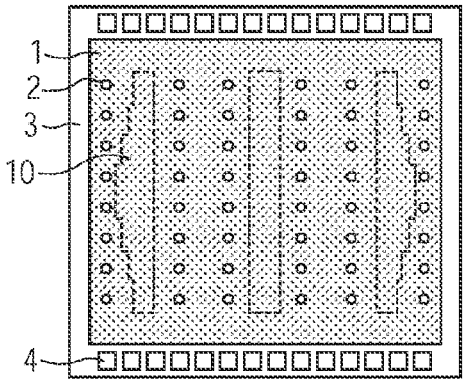
Figure 11C:
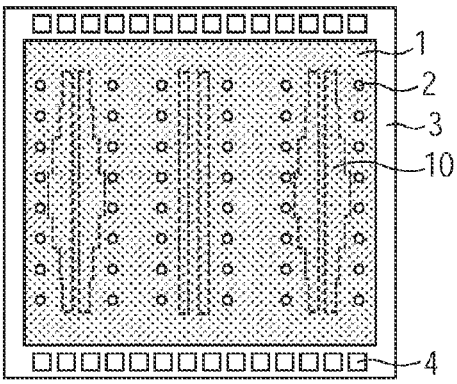
Figure 11D:
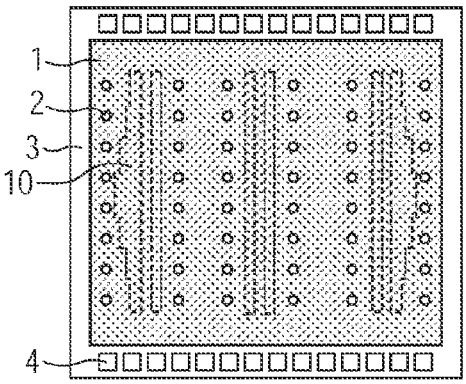

The configurations illustrated in FIG. 11C and FIG. 11D are configurations in which the same thought as that in the second embodiment is applied to each row of the ink supply orifices in both sides, which tends to be easily deformed, compared to the row of the ink supply orifices in the central side of the substrate. There is the case where the stress 9 is concentrated on each row of the ink supply orifices in both the sides to easily cause the deformation, compared to the row of the ink supply orifices in the central side. In this case, a beam-like projection having a uniform width is arranged in the row of the ink supply orifices in the central side, and a beam-like projection to which the same thought as that in the second embodiment is applied can be given to the row of each of the ink supply orifices in both the sides. Thereby, even in the configuration in which the plurality of ink supply orifices 11 are provided, the ejection orifice forming member 1 resists being deformed on the whole region of the recording element substrate 6, and the peeling of the ejection orifice forming member 1 can be suppressed. As a result, the liquid ejection head can keep an operation of producing recorded articles of a high grade.

Figure 11E:
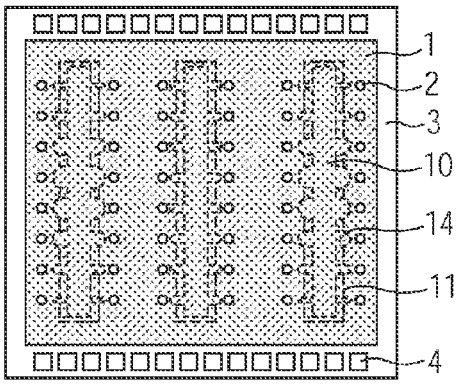
Figure 11F:
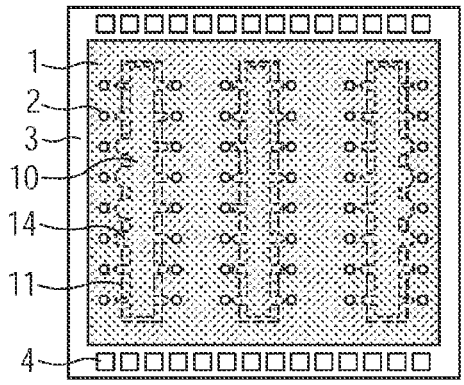

The configurations illustrated in FIG. 11E and FIG. 11F are configurations in which the same thought as that in the third embodiment is incorporated in each of the ink supply orifices in both sides, which is easily deformed, compared to the ink supply orifice in the central side of the substrate. In the case where the stress 9 is concentrated on each of the ink supply orifices in both sides to easily cause the deformation, compared to the ink supply orifice in the central side, a reinforcing rib 14 having a conventional structure can be arranged in the ink supply orifice in the central side, and the reinforcing rib 14 incorporating the same thought as that in the third embodiment can be provided on the rows of the ink supply orifices in the outer side. Thereby, even in the configuration in which the plurality of ink supply orifices 11 are provided, the ejection orifice forming member 1 resists being deformed on the whole region of the recording element substrate 6. As a result, when the seventh embodiment is used, a droplet 13 is enabled to stably land at a desired position, and the liquid ejection head can keep an operation of producing recorded articles of a high grade, also in the configuration in which the plurality of ink supply orifices 11 are provided.

The above described configuration examples are a part of the seventh embodiment, and it is apparent that a similar shape which includes a configuration in which a combination of the structures described in the present specification is changed and easily comes to mind is also included in the present invention. In addition, in the present embodiment, the width of the beam-like projection 10 and the volume of the reinforcing rib 14 are described, but such a structure is also included in the present invention that the thicknesses of the beam-like projection and the reinforcing ribs in the thickness direction of the ejection orifice forming member (amounts of projection) are differentiated between both the ends and the central part in the array direction of the ejection orifices.

The combination of the reinforcing rib which extends from the beam-like projection and the columnar projection may be used in one ejection orifice forming member as needed, though the figure is not shown.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-086468, filed Apr. 17, 2013, which is hereby incorporated by reference herein in its entirety.

What is claimed is:

1. A liquid ejection head comprising:

a substrate which has an energy-generating element that generates energy to be utilized for ejecting a liquid, and a supply orifice for supplying the liquid to the energy-generating element; and an ejection orifice forming member that has a plurality of ejection orifices through which the liquid is ejected, and at least one beam-like projection which projects toward the substrate and extends along an array direction of the ejection orifices at a position corresponding to the supply orifice, wherein a sectional area perpendicular to the array direction of the ejection orifices at the central part of the beam-like projection in the array direction of the ejection orifices is larger than a sectional area in the direction perpendicular to the array direction of the ejection orifices at both ends of the beam-like projection in the array direction.

2. The liquid ejection head according to claim 1, wherein one beam-like projection is provided for one supply orifice.

3. The liquid ejection head according to claim 2, wherein the plurality of ejection orifices are arrayed to form two rows of ejection orifices, and two beam-like projections are provided along the two rows of the ejection orifices, respectively.

4. The liquid ejection head according to claim 3, wherein one beam-like projection out of the two beam-like projections has a relatively larger sectional area of the central part in the array direction of the ejection orifices than that of the ends, and the other beam-like projection has a sectional area which is uniform in the array direction of the ejection orifices.

5. The liquid ejection head according to claim 1, wherein two beam-like projections are provided for one supply orifice.

6. The liquid ejection head according to claim 5, wherein the two beam-like projections have the same distance between either end of the beam-like projections in the array direction of the ejection orifices and the ejection orifice closest to the end.

7. The liquid ejection head according to claim 5, wherein at least one beam-like projection out of the two beam-like projections has a relatively larger sectional area of the central part in the array direction of the ejection orifices than that of the ends.

8. The liquid ejection head according claim 1, wherein the beam-like projection has a groove formed along the array direction of the ejection orifices.

9. A liquid ejection head comprising:

a substrate which has an energy-generating element that generates energy to be utilized for ejecting a liquid, and a supply orifice for supplying the liquid to the energy-generating element; and an ejection orifice forming member that has a plurality of ejection orifices through which the liquid is ejected, a beam-like projection which projects toward the substrate and extends along an array direction of the ejection orifices at a position corresponding to the supply orifice, and a plurality of reinforcing ribs which project from the beam-like projection toward the ejection orifices and are in contact with the substrate, wherein a volume of the reinforcing ribs which are arranged at the central part of the beam-like projection in the array direction of the ejection orifices is larger than a volume of the reinforcing ribs which are arranged at the ends of the beam-like projection in the array direction of the ejection orifices.

10. The liquid ejection head according to claim 9, wherein a length of the reinforcing ribs which are arranged at the central part and extend in a direction toward the ejection orifices is longer than a length of the reinforcing ribs which are arranged at both the ends.

11. The liquid ejection head according to claim 9, wherein as for the reinforcing ribs arranged in the central part, a sectional area of the reinforcing ribs in a direction along the array direction is larger than a width of the reinforcing ribs arranged at both the ends.

12. The liquid ejection head according to claim 9, wherein, a pitch in the array direction of the reinforcing ribs arranged at the central part is smaller than a pitch of the reinforcing ribs arranged at both the ends.

13. The liquid ejection head according to claim 9, wherein the reinforcing ribs extend from both sides of the beam-like projection sandwiched between the reinforcing ribs, and as for the reinforcing ribs on at least one side among the reinforcing ribs arranged on both the sides, an area of the reinforcing ribs provided at the central part of the beam-like projection in the array direction of the ejection orifices is larger than that of the reinforcing ribs provided at the ends.

14. A liquid ejection head comprising:

a substrate which has a plurality of energy-generating elements which generate energy to be utilized for ejecting a liquid, and a plurality of supply orifices for supplying the liquid to the energy-generating elements; and an ejection orifice forming member that has a plurality of ejection orifices through which the liquid is ejected, a beam-like projection which projects toward the substrate and extends along an array direction of the ejection orifices at a position corresponding to the supply orifices, and a plurality of columnar projections in between the plurality of supply orifices, which project toward the substrate, wherein a sectional area perpendicular to the array direction of the ejection orifices at the central part of the beam-like projection in the array direction of the ejection orifices is larger than a sectional area in the direction perpendicular to the array direction of the ejection orifices at both ends of the beam-like projection in the array direction.

15. The liquid ejection head according to claim 14, wherein a sectional area in a direction along a principal surface of the substrate of the columnar projections arranged at the central part in the array direction of the ejection orifices out of the plurality of columnar projections is larger than a sectional area of the columnar projections arranged at both the ends in the array direction.

16. The liquid ejection head according claim 14, wherein the substrate has the plurality of supply orifices arrayed along the array direction of the ejection orifices, and also the plurality of energy-generating elements arrayed on both sides of the row of the supply orifices, the ejection orifice forming member has a plurality of columnar projections provided in between the supply orifices, which project toward the substrate in the row of the supply orifices, and a sectional area in a direction along a principal surface of the substrate of the columnar projections arranged at the central part is larger than that of the columnar projections arranged at both the ends.

* * * * *